US005178589A

United States Patent [19]

Wilson et al.

[11] Patent Number: 5,178,589

[45] Date of Patent: Jan. 12, 1993

[54] DUAL POSITION EXERCISE APPARATUS

[75] Inventors: Jerry L. Wilson, Rt. 1, Box 599, Hillsboro, Oreg. 97124; Richard A. Edinger, Hillsboro, Oreg.

[73] Assignees: Jerry L. Wilson; Marilyn E. Wilson; Connie D. Wilson; Stuart B. Wilson; Brian D. Wilson; Molly M. Wilson, all of Hillsboro, Oreg.

[21] Appl. No.: 836,110

[22] Filed: Feb. 14, 1992

[51] Int. Cl.[5] ..... A63B 22/06

[52] U.S. Cl. ..... 482/62; 482/57

[58] Field of Search ..... 482/57, 62, 148, 58, 482/60, 63, 72

[56] References Cited

U.S. PATENT DOCUMENTS 3,057,201 10/1962 Jaeger ..... 482/57

4,538,804 9/1985 Zibell ..... 482/57

FOREIGN PATENT DOCUMENTS 1468272 12/1966 France ..... 482/62

*Primary Examiner*—Stephen R. Crow

*Attorney, Agent, or Firm*—Chernoff, Vilhauer

[57] ABSTRACT

A rotary exercise apparatus includes a frame which supports a seat assembly and a rotary crank mechanism. The frame has two sets of legs, one which supports the apparatus in an upright position where the crank mechanism can be used by someone sitting on the seat assembly to perform upper body exercises, and another which supports the apparatus in a reclined position where the crank mechanism can be used by someone sitting on the seat assembly to perform lower body exercises. The crank mechanism permits variable amounts of resistance to be imparted against its rotation by urging a shoe having a high friction liner against a rotatably mounted shaft that carries the crank arms. The location of the crank mechanism along the frame and the length of the arms are adjustable to accommodate different size users. In addition, the arms are replaceable to permit different size and shape arms carrying appropriate engagement devices to be used for each type of exercise. When the apparatus is in its reclined position, the seat assembly provides both a seat and a back rest.

15 Claims, 4 Drawing Sheets

DUAL POSITION EXERCISE APPARATUS

BACKGROUND AND SUMMARY OF THE INVENTION

Rotary exercise machines are an effective way of applying aerobic exercise to both upper and lower body muscles. However, because upper body muscles are exercised on such an apparatus by rotating a crank with the user's arms, and lower body muscles are exercised by rotating the crank with the user's leg, it is difficult to place a single crank such that it can conveniently be used for both types of exercise.

Dranselka, U.S. Pat. No. 4,739,984, Zibell, U.S. Pat. No. 4,538,804, Boyko, U.S. Pat. No. 2,688,709, Wentz, U.S. Pat. No. 2,673,088 and Swiss Patent No. 461,838 each disclose a rotary exercise apparatus in which the same crank mechanism is used to exercise both the arms and the legs. Zibell discloses a freestanding apparatus where the user lies on an inclined platform to exercise his/her legs and sits on the same inclined platform to exercise his/her arms. While this apparatus allows the same crank to be used for both types of exercise, it does so by placing the user in an uncomfortable position for both types of exercise. The exercise machines shown in Wentz and the Swiss patent both require another piece of equipment, such as a chair and bed, or both, to perform the exercises. The devices shown in Dranselka and Boyko also require the use of a chair, and further the chair must be of the type that will permit the exercise apparatus to be attached to it.

The subject invention overcomes the limitations and shortcomings of the prior art rotary exercise apparatus by providing a frame that supports a seat assembly and a rotary crank mechanism. Two sets of legs are attached to the frame, a first set orients the apparatus in an upright position where the crank mechanism is positioned so that a user sitting on the seat can rotate the crank mechanism with his/her arms. A second set of legs supports the apparatus in a reclined position where the crank mechanism is positioned so that a user sitting on the seat can rotate the crank mechanism with his/her legs. In a preferred embodiment of the invention, there are three legs with the center leg being part of both sets. In addition, the seat assembly includes two seat elements that releaseably attach to the frame in one manner when the exercise apparatus is in its upright position and another manner when the exercise apparatus is in its reclined position. The seat elements are arranged to provide both a seat and a backrest when the apparatus is in its reclined position.

Preferably, the resistance of the crank mechanism is adjustable to accommodate users having different needs. This is accomplished in a preferred embodiment by rotatably journaling a shaft that has a crank arm attached to each of its extremities in a hollow cylindrical housing that is attached to the frame. A shoe, that is slidable in the housing, has an arcuate lower surface with a leather liner that overlays a portion of the shaft. A clamp mechanism permits the shoe to be urged against the shaft with varying amounts of force to provide different levels of rotational resistance. A heat dissipater surrounds the portion of the housing that journals the shaft to prevent heat generated by the frictional interaction between the shoe liner and the shaft from causing the temperature of the housing to raise to a level where a user could be burned.

In a preferred embodiment, the housing can be placed at several locations along the frame, and the arms can be attached to the shaft at several locations along their length in order to accommodate different size users. Finally, longer Z-shaped arms, having hand grips at their extremities, are provided for use in performing upper body exercises, and shorter straight arms, having pedals at their extremities, are provided for use in performing lower body exercises.

Accordingly, it is a principal object of the subject invention to provide a self-contained rotary exercise apparatus in which the rotary crank mechanism can be used for performing both upper and lower body exercises.

It is a further object of the subject invention to provide such an apparatus having two sets of legs, one set which supports the apparatus in an upright position for performing upper body exercises and another set which supports the apparatus in a reclined position for performing lower body exercises.

It is a further object of the subject invention to provide such an apparatus which has a releaseably attached seat assembly which is mountable in a manner to permit a user to properly sit on the apparatus for performing both types of exercise.

It is a still further object of the subject invention to provide such a seat assembly which provides a back rest when the apparatus is in its reclined position.

It is a further object of the subject invention to provide such an apparatus in which a variable amount of resistance force can be exerted against rotation of the crank mechanism.

It is a yet further object of the subject invention to provide such an apparatus in which the crank mechanism can be placed at various locations along the frame which support it to accommodate different size users.

It is a further object of the subject invention to provide such an apparatus in which the arms of the crank mechanism can be made longer or shorter to accommodate different size users.

It is a yet further object of the subject invention to provide such an apparatus in which one set of arms is provided for performing upper body exercises and a second set of arms is provided for performing lower body exercises.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
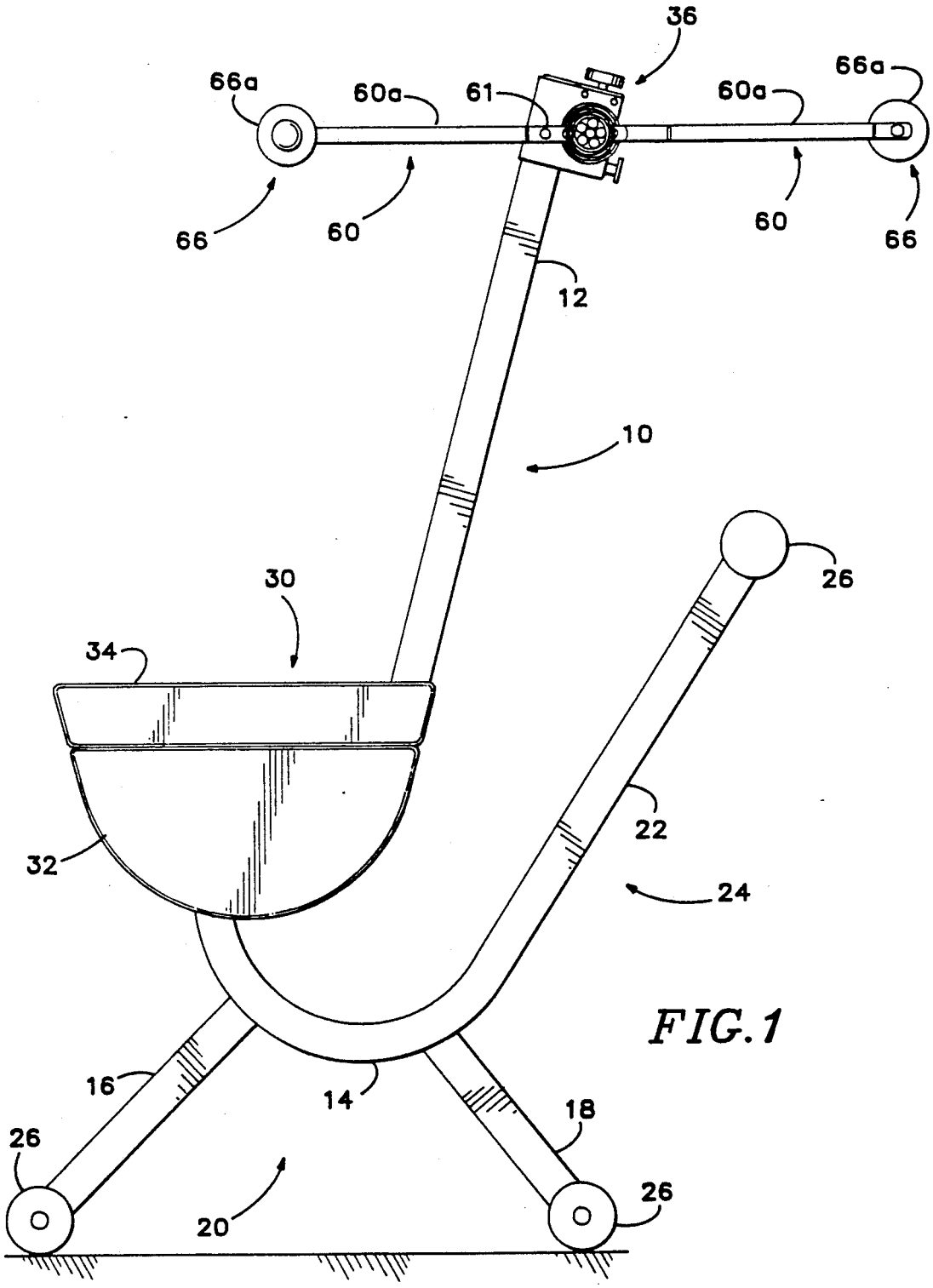
FIG. 1 is a side elevation view of an exercise apparatus embodying the subject invention in an upright position for performing upper body exercises.
Figure 2:
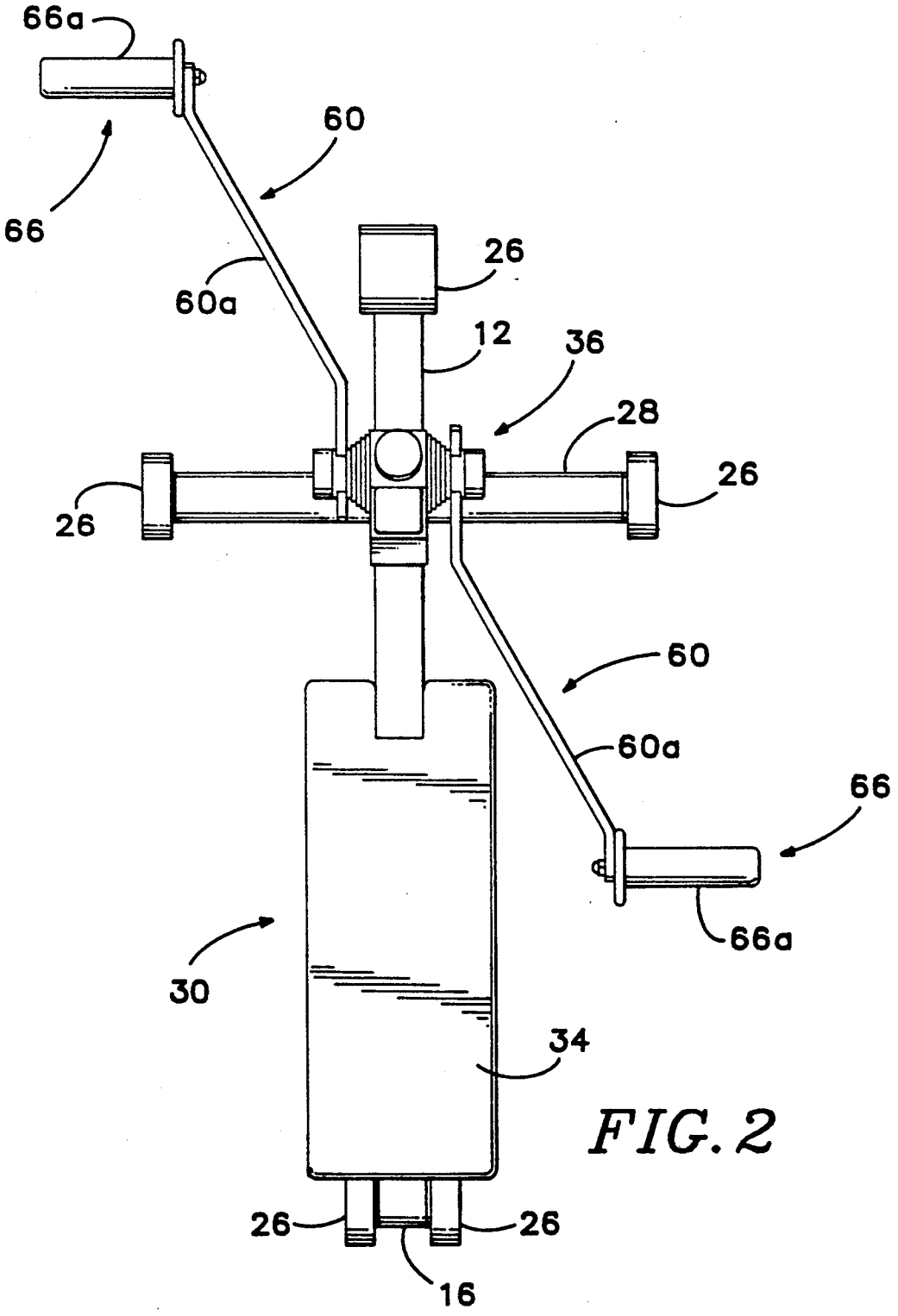
FIG. 2 is a plan view of the exercise apparatus of FIG. 1.
Figure 3:
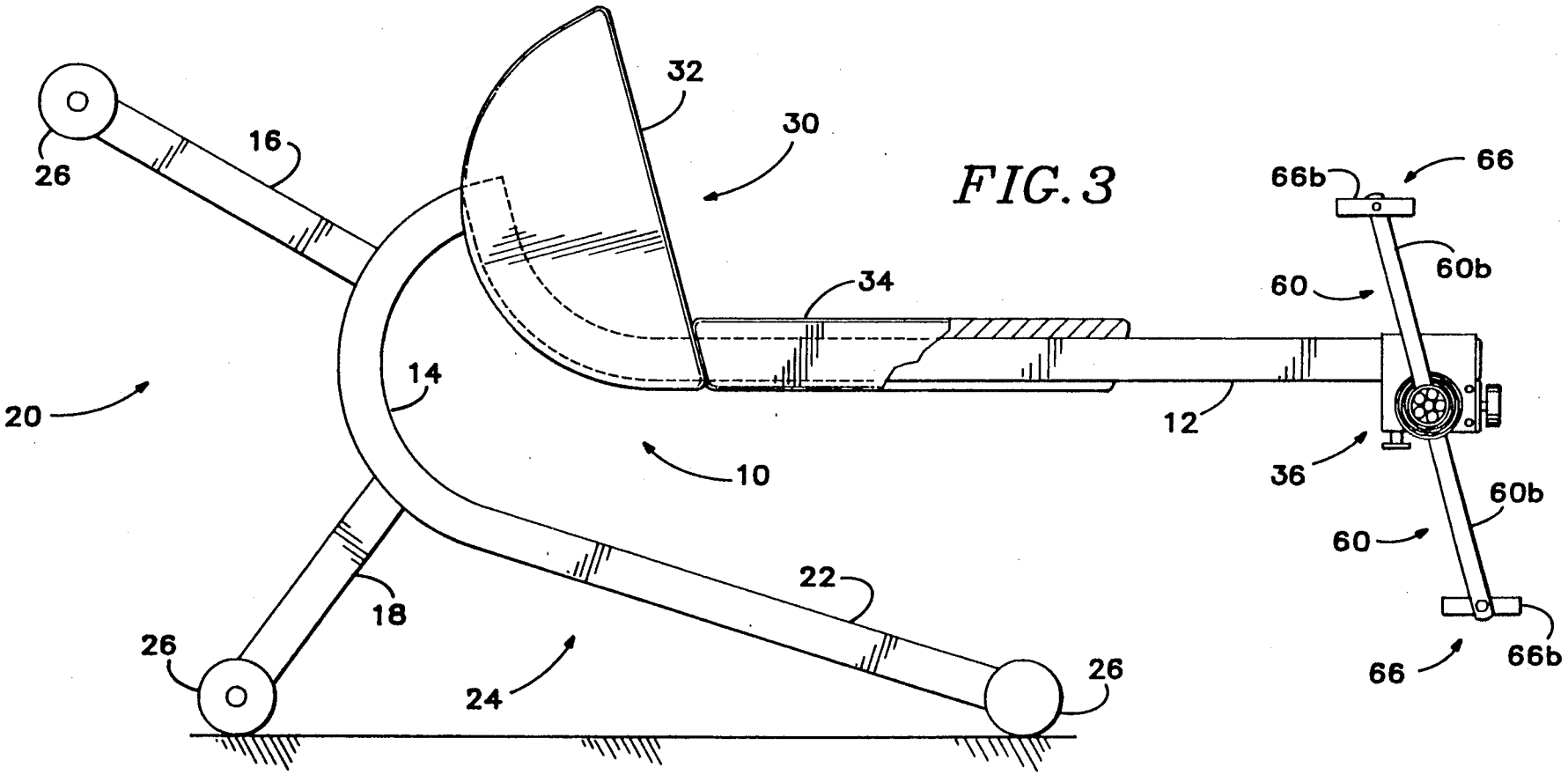
FIG. 3 is a side elevation view of the exercise apparatus in a reclined position for performing lower body exercises.

Referring to FIGS. 1-3 of the drawings, an exercise apparatus includes a frame 10. In the embodiment illustrated, the frame is made from bent, rectangular cross-sectioned, steel tubing in order to provide a strong relatively lightweight apparatus. The frame includes a J-shaped upper frame element 12 and a U-shaped lower frame element 14 that is joined to the upper frame element at the extremity of its curved end.

Extending outwardly from the lower frame element are three legs. A first leg 16 and second leg 18 provide a first set of legs 20. When the exercise apparatus is positioned on the first set of legs it is upright with the upper frame element 12 oriented at a small angle with respect to the vertical, FIG. 1. The second leg 18 and a third leg 22 provide a second set of legs 24 which support the exercise apparatus in a reclined position with the upper frame element 12 oriented nearly horizontal, FIG. 3. Located at the extremity of both the first and second leg elements 16 and 18 are a pair of cylindrical pads 26 which act as feet. A crossbar 28, located at the extremity of the third leg 22 carries pads 26 at each of its ends.

An elongate seat assembly 30 releasably attaches to the upper frame element 12 such that a user can sit on the exercise apparatus when it is in either its upright or reclined positions. A first seat element 32 has an arcuate bottom surface that conforms to the curved portion of the upper frame element, and a planar top surface. A rectangular slot, that extends around approximately one-half of the bottom surface, fits snugly over the upper frame element so that the first seat element is attached to the frame with its upper surface parallel with the ground when the exercise apparatus is in its upright position. A second seat element 34 has parallel planar top and bottom surfaces and has rectangular slots extending across its bottom surface and one of its ends. When the exercise apparatus is in its upright position, the second seat element sits on top of the first seat element and the slot in its end engages the straight portion of the first frame element 12. When the exercise apparatus is in its reclined position, the slot in the bottom surface of the second seat element is placed on the straight portion of the first frame element 12. The upper surface of the second seat element then is horizontal and provides a seat, and the upper surface of the first seat element is inclined slightly rearwardly from the vertical and provides a back rest.

Located on the first frame element 12 near its extremity is a crank mechanism 36 that can be used to exercise a user's arms or legs depending on the orientation of the exercise apparatus. When the exercise apparatus is in its upright position, FIG. 1, the user sits on the seat assembly 30 with his/her legs straddling the apparatus and rotates the crank mechanism with his/her arms. When the exercise apparatus is in its reclined position, FIG. 3, the user sits on the second seat element 34, leans back against the first seat element 32 and rotates the crank mechanism with his/her legs.

Figure 5:
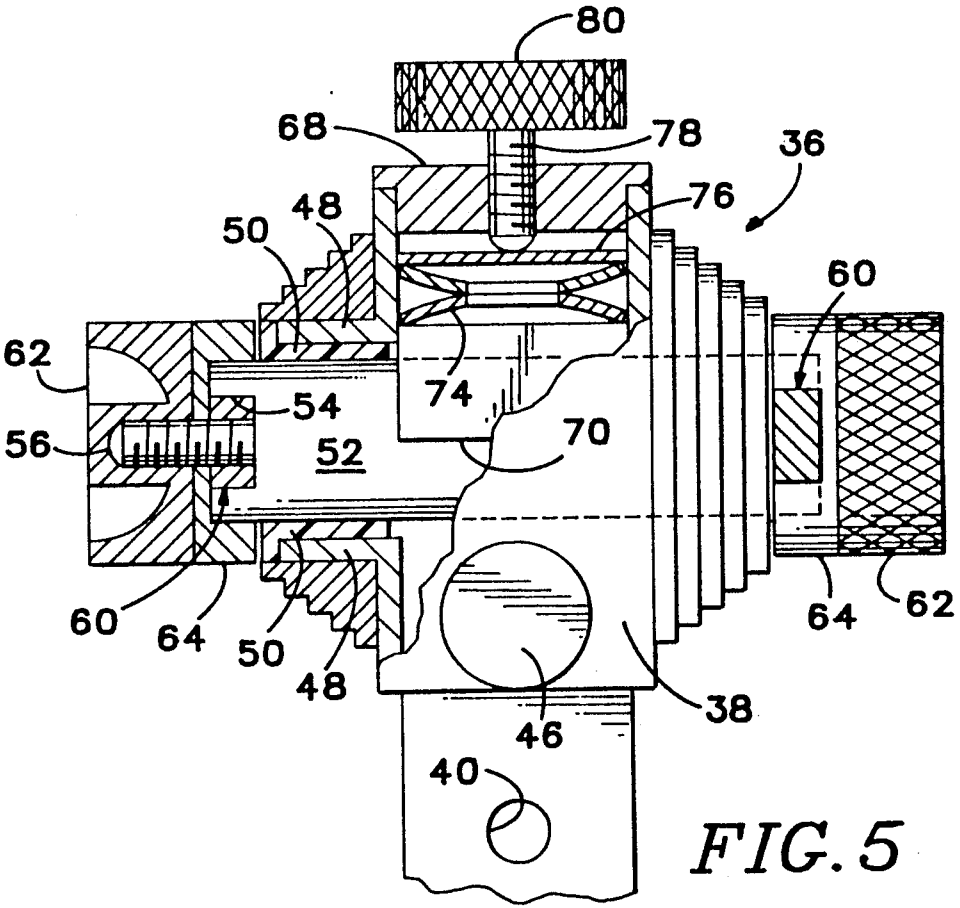
FIG. 5 is a plan view, partially broken away, of the portion of the crank mechanism shown in FIG. 4.
Figure 4:
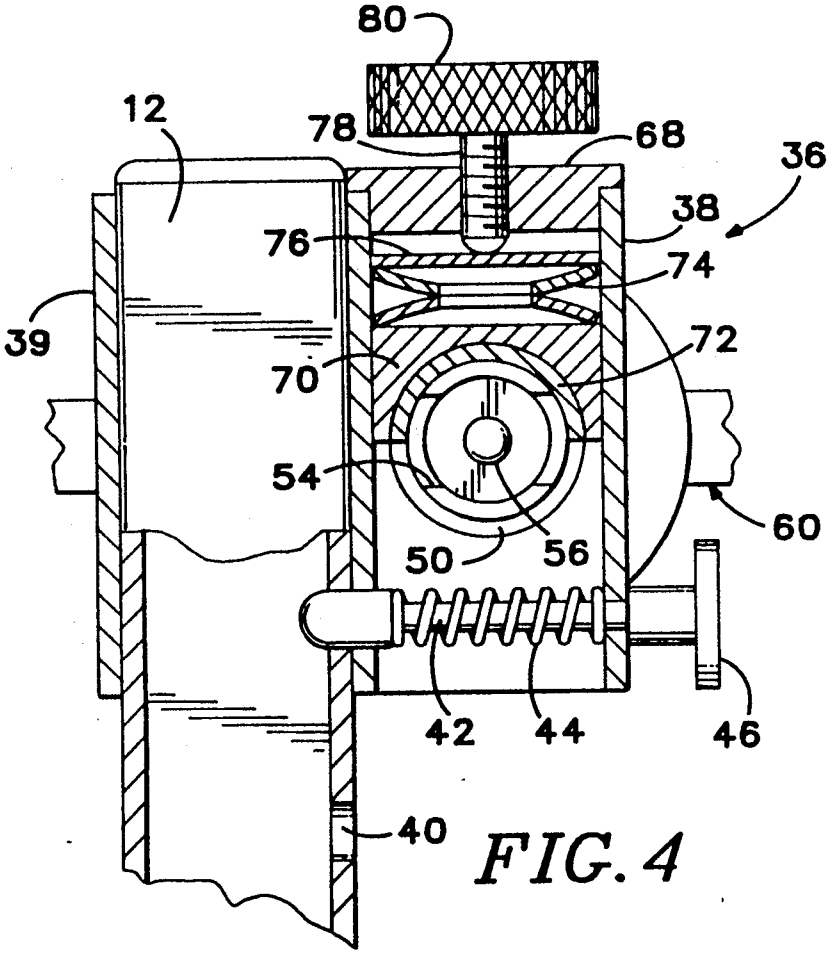
FIG. 4 is a side elevation view, partially broken away to show hidden details, of a portion of the crank mechanism of the exercise apparatus, at an enlarged scale.

Referring now also to FIGS. 4 and 5, the crank mechanism 36 includes a housing 38 which is attached to a hollow rectangular sleeve 39 that fits slidably over the upper frame element 12. Holes 40, that are located at spaced intervals along the upper frame element, are engaged by a plunger 42 that extends through the housing 38. A spring 44 urges the plunger into one of the holes 40, when they are aligned, to lock the housing immovable along the upper frame element. However, the housing can be moved to another location along the upper frame element merely by using a handle 46, located at the outer end of the plunger, to pull the plunger out of the hole it is lodged in.

Located on each side of the housing 38 are hollow cylindrical bosses 48 which carry axially aligned bearings 50. A cylindrical shaft 52 is rotatably journaled in the bearings 50 and protrudes from the bosses 48. The shaft has a rectangular notch 54 located in each of its ends and a threaded rod 56 extends outwardly from the center of each end of the shaft through the respective notch 54. An elongate arm 58, having a series of spaced-apart holes 61 near its inner end, fits into each notch 54 with the respective threaded rod 56 passing through one of the holes 61. A knurled nut 62, which engages the threaded bolt, presses a thrust bearing 64 against each arm 60 to hold it in the notch 54. Located at the outer extremity of each arm is an engagement device 66 which is engaged by the user's hands or feet.

When the exercise apparatus is in its upright position, for exercising the user's arms, the arms **60*a* are Z-shaped in order to offset the engagement devices from the upper frame element by an amount comparable to the shoulder width of an average user. In this embodiment the engagement devices are hand grips 66*a*. When the exercise apparatus is in its reclined position, for exercising the user's legs, the arms 60*b* are straight and are considerably shorter than the arms 60*a*. In this configuration, the engagement devices are pedals 66*b***.

The upper end of the housing 38 is enclosed with a removable lid 68 that has a threaded hole extending medially through it. Slidably mounted in the housing 38 is a shoe 70 having an arcuate lower surface that matingly conforms to the shaft 52. A high friction liner 72, preferably made of leather, is attached to the shoe's lower surface. Located in the housing 38, immediately above the shoe 70, are a pair of opposed bellivile springs 74, and an end plate 76 is located above the springs. A bolt 78, having a large cylindrical knurled head 80, extends through the threaded hole in the lid 68 into contact with the end plate. Thus, by tightening the bolt 78 the shoe is urged against the shaft and the increased frictional interaction between the liner 72 and the shaft creates an increased amount of resistance against rotation of the crank mechanism.

Stepped cylindrical heat dissipation elements 80 are placed around the bosses 48 to prevent heat generated by the frictional interaction between the liner and shaft from raising the temperature of the crank mechanism to a level where it could burn the user.

In use the exercise apparatus can be adjusted to different size users by pulling the plunger 46 free of the hole 40 it is in, sliding the housing 38 along the upper frame element 12 to the desired position where the plunger is centered on another hole 40, and releasing the plunger. In addition, the length of the arms 60 can be set to the proper length by removing each nut 62, taking the arm off of the threaded rod 76 and reinserting the threaded rod through another hole 61 in the arm. Finally, the tension of the crank mechanism is adjustable by tightening or loosening the bolt 78.

It will be noted that the first and second legs 16, 18 are relatively close together since the user's weight is centered over the seat 30 when the exercise apparatus is in its upright position. On the other hand, the second and third legs 18, 22 are relatively further apart since the user's weight is not so concentrated when the exercise apparatus is in its reclined position. In addition, the crossbar 28 at the extremity of the third leg increases the stability of the apparatus when it is in its reclined position, where it is inherently less stable.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise apparatus comprising:

(a) a frame;

(b) seat means mounted on said frame for supporting a person in a sitting position;

(c) a rotary crank mechanism mounted on said frame;, (d) a first leg and a second leg for supporting the apparatus in an upright position where a person sitting on said seat means can rotate said crank mechanism using his/her arms; and (e) a third leg for supporting the apparatus along with said second leg when said frame is rotated to a reclined position where a person sitting on said seat means can rotate said crank mechanism using his/her legs.

2. The apparatus of claim 1 wherein said crank mechanism includes resistance means for imparting resistance against rotation of said crank mechanism.

3. The apparatus of claim 2 wherein the amount of resistance imparted by said resistant means can be varied.

4. The apparatus of claim 1, including means for positioning said crank mechanism on said frame at different amounts of separation from said seat means.

5. The apparatus of claim 1 wherein said crank mechanism includes a pair of opposed arms having engagement means at their extremities.

6. The apparatus of claim 5, including means for varying the length of said arms.

7. The apparatus of claim 5 wherein said are removably attached to said crank mechanism.

8. The apparatus of claim 5 wherein said engagement means comprises hand grips.

9. The apparatus of claim 5 wherein said engagement means comprises pedals.

10. The apparatus of claim 1 wherein said seat means comprises a first seat element and a second seat element and said second seat element is mounted on top of said first seat element when the apparatus is in its upright positions, and said first seat element is oriented substantially normal to said second seat element when the apparatus is in its reclined position.

11. The apparatus of claim 2 wherein said crank mechanism comprises:

(a) a housing having a bearing mounted therein;

(b) a shaft, having opposed extremities, rotatably journaled in said bearing;

(c) a shoe having a high coefficient friction liner that overlays a portion of said shaft; and (d) clamp means for urging said liner against said shaft within an adjustable amount of force.

12. The apparatus of claim 11 wherein said liner is leather.

13. The apparatus of claim 11 wherein said clamp means comprises:

(a) a cavity that slidably receives said shoe;

(b) a cover for said cavity having a threaded opening defined therein;

(c) a bolt that extends through said threaded opening; and (d) one or more bellivile springs interposed in said cavity between said bolt and said shoe.

14. The apparatus of claim 11 wherein said crank mechanism includes heat dissipation means for preventing heat generated by frictional engagement between said liner and said shaft from raising the temperature of said housing beyond a predetermined level.

15. The apparatus of claim 11 wherein said crank mechanism comprises:

(a) a pair of arms; and (b) means for releasably attaching one of said arms to each extremity of said shaft.

* * * * *

UNITED STATES PATENT AND TRADEMARK OFFICE

CERTIFICATE OF CORRECTION

PATENT NO. : 5,178,589

DATED : January 12, 1993

INVENTOR(S) : Jerry L. Wilson, Richard A. Edinger

It is certified that error appears in the above-identified patent and that said Letters Patent is hereby corrected as shown below:

Col. 6, Line 1, insert -- arms -- after "said"

Signed and Sealed this

Ninth Day of November, 1993

*Attest:*

*Attesting Officer*

Bruce Lehman

BRUCE LEHMAN

*Commissioner of Patents and Trademarks*